US008574375B2

(12) United States Patent
Ott et al.

(10) Patent No.: US 8,574,375 B2
(45) Date of Patent: Nov. 5, 2013

(54) COMPONENT FOR A PAINTING INSTALLATION AND DEVICE FOR REMOVING PAINT THEREFROM

(75) Inventors: Matthias Ott, Dohren (DE); Klaus Vissing, Morsum (DE); Gabriele Neese, Bremen (DE); Volkmar Stenzel, Thedinghausen (DE); Guido Ellinghorst, Bremen (DE); Walter Hügle, Rudersberg (DE)

(73) Assignee: Fraunhofer Gesellschaft zur Forderung der Angewandten Forschung E.V., Munich (DE)

( * ) Notice: Subject to any disclaimer, the term of this patent is extended or adjusted under 35 U.S.C. 154(b) by 918 days.

(21) Appl. No.: 11/887,851

(22) PCT Filed: Apr. 7, 2006

(86) PCT No.: PCT/EP2006/061463

§ 371 (c)(1),
(2), (4) Date: May 8, 2008

(87) PCT Pub. No.: WO2006/106149

PCT Pub. Date: Oct. 12, 2006

(65) Prior Publication Data

US 2009/0056750 A1 Mar. 5, 2009

(30) Foreign Application Priority Data

Apr. 8, 2005 (DE) ..... 10 2005 016 422
Apr. 8, 2005 (DE) ..... 20 2005 005 698 U

(51) Int. Cl.
*B08B 7/00* (2006.01)

(52) U.S. Cl.
USPC ..... 134/38

(58) Field of Classification Search
None
See application file for complete search history.

(56) References Cited

U.S. PATENT DOCUMENTS

| | | | | |
|---|---|---|---|---|
| 4,443,271 | A * | 4/1984 | Goerss | 134/34 |
| 4,704,986 | A * | 11/1987 | Remp et al. | 118/318 |
| 4,715,539 | A * | 12/1987 | Steele | 239/263 |
| 2003/0175525 | A1 * | 9/2003 | Wochnowski et al. | 428/423.1 |
| 2004/0180210 | A1 * | 9/2004 | Vissing et al. | 428/421 |

FOREIGN PATENT DOCUMENTS

| | | | |
|---|---|---|---|
| JP | 6231964 | | 8/1994 |
| JP | 10138141 | A * | 5/1998 |
| JP | 2003-024880 | | 1/2003 |
| WO | WO 03002269 | A2 * | 1/2003 |

OTHER PUBLICATIONS

English Machine Translation of JP10-138141A.*
Coatings Clinic, by Clifford K. Schoff, Feb. 2006, CoatingsTech, 492 Norristown Rd., Blue Bell, PA 19422; email: publications@coatingstech.org.

* cited by examiner

*Primary Examiner* — Nicole Blan
(74) *Attorney, Agent, or Firm* — Preti Flaherty Beliveau & Pachios LLP

(57) ABSTRACT

This invention concerns a component for a painting facility which is contaminated with paint during operation of the painting facility, e.g. a grating, a hanger, a cover and similar, characterized in that it is coated with a plasma polymeric coating containing oxygen, carbon and silicon.

8 Claims, 2 Drawing Sheets

COMPONENT FOR A PAINTING INSTALLATION AND DEVICE FOR REMOVING PAINT THEREFROM

Figure 1:
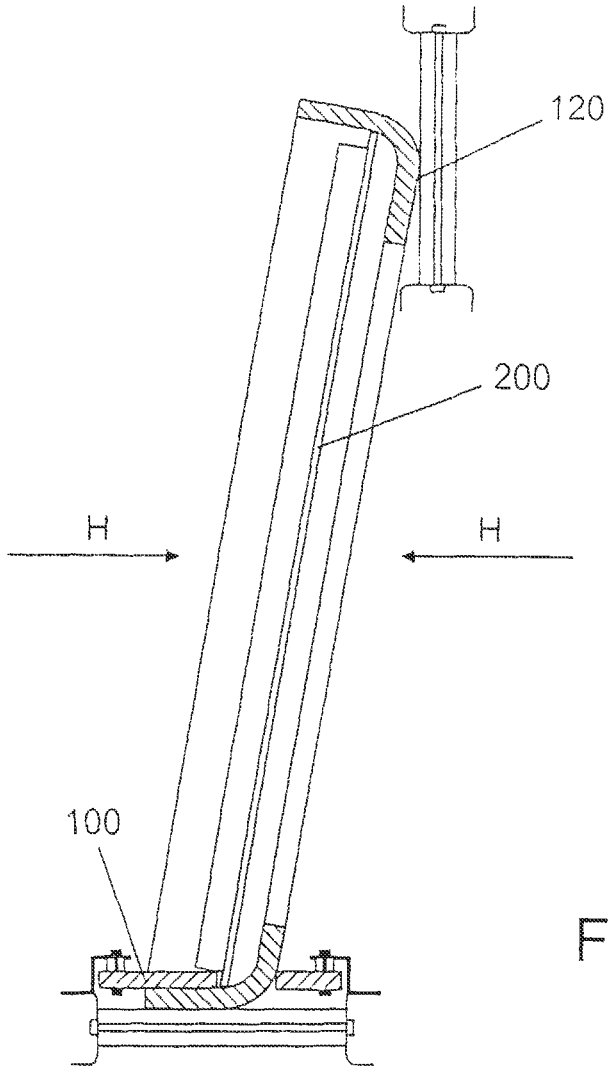

This application is a §371 national phase filing of PCT/EP2006/061463 filed Apr. 7, 2006, and claims priority to German application No. 20 2005 005 698.7 filed Apr. 8, 2005, and to German application No. 10 2005 016 422.6 filed Apr. 8, 2005.

The invention concerns a component for a painting facility which is contaminated with paint during operation of the painting facility, and a device for removing paint from such components.

Such components form, for instance, floor areas, supports for the parts to be painted or covering areas in paint booths. Thus in painting facilities, for instance, gratings for floor areas are used. The parts to be painted are positioned on hangers, and painted in mostly automatic painting facilities. Such painting facilities, e.g. paint lines, are used, for instance, in the motor vehicle industry, for painting body parts or whole bodies. In particular, the purpose of using gratings as floor parts is also to vent the painting facility. Because of the air flow, adhesions of paint residues occur, and seal the openings of the gratings and thus have a negative effect on the air flow, so that paint must be completely removed from them from time to time. This is done in very varied ways. For instance, chemical or physical paint removal methods, e.g. by means of sand jets or similar, are used. Combinations of chemical and physical paint removal methods are also used.

From DE 29 52 391 A1, a method and a device for removing paint residues which have remained adhering to the spray slits when objects are spray painted have become known, the spray slits being sprayed with water under pressure.

To achieve a satisfactory paint removal result, in the case of paint removal using a high pressure water jet very high pressures from 1600 to 3000 bar must be used. The use of such high pressures results in high wear in the high pressure water pumps which are used to generate these pressures. Additionally, when high pressures are used, a high water throughput is necessary. The result is high operating costs.

The invention is therefore based on the problem of firstly finding a component for painting facilities which can be cleaned better and faster compared with traditional components. Secondly, a device which makes paint removal from such painting facility components efficiently possible should be found.

This object is achieved by a component for a painting facility which is contaminated with paint during operation of the painting facility, e.g. a grating, a hanger, a cover and similar, characterized in that it is coated with a plasma polymeric coating containing oxygen, carbon and silicon.

Coating the components which are used for such painting facilities, e.g. gratings, hangers, cover plates and similar with a plasma polymeric coating containing oxygen, carbon and silicon has the great advantage that such a coating not only has high mechanical and chemical stability, particularly at higher temperatures, but also has improved hydrophobic or oleophobic behaviour, so that the components are easier to clean, since they already have an effective surface which repels dirt. The coating of the components preferably has properties such as emerge from DE 101 31 156 A1 or WO 03/002269A2, which are both included in full in this application for the purpose of disclosure.

Preferred components according to the invention for painting facilities include a plasma polymeric coating containing oxygen, carbon and silicon, which is joined to the substrate and preferredly plane with it, and to which the following applies:

- the material quantity ratio O:Si is ≥1.1, preferredly ≥1.2, more preferredly ≥1.25, where >1.35 and >1.4 are each again preferred,
- and simultaneously ≤2.6, preferredly ≤2.0, more preferredly ≤1.9
- and the material quantity ratio C:Si is ≥0.6, preferredly ≥1.00, more preferredly ≥1.2, in turn preferredly ≥1.29
- and simultaneously ≤C 2.2, preferredly ≤2.0, more preferredly ≤1.9, where >1.76 and <1.7 are each again preferred, measured by ESCA (electron spectroscopy for chemical analysis) preferredly on the side facing away from the substrate (for more information about measurement, see DE 10131156 A1 and WO 03/002269 A2). The person skilled in the art knows, in connection with composition specifications, that only measurement of contamination-free areas of the layer is useful. Here and below, "material quantity ratio X:Y" is understood as the ratio ($n_x$:$n_y$). In this context, preferred combinations of the maximum and minimum values of the material quantity ratios are the first-listed, second-listed and third-listed minimum value with the respective first-listed, second-listed and third-listed maximum value for the above-mentioned material quantity ratios.

The plasma polymeric coating according to the invention preferably includes, relative to its total number of atoms excluding hydrogen and/or fluorine,

- minimum 22, preferredly 23, more preferredly 23.9 and maximum 27, preferredly 26.1, more preferredly 25 atoms percent Si,
- minimum 25, preferredly 27, more preferredly 29, again 31 and 34.2 each being preferred, and maximum 50, preferredly 47, more preferredly 40.2 atoms percent O, and
- minimum 25, preferredly 27, more preferredly 34 and maximum 50, preferredly 48, more preferredly 46 atoms percent C, where 44 and 40 atoms percent are each again preferred, measured by ESCA (electron spectroscopy for chemical analysis) preferredly on the side facing away from the substrate (for more information about measurement, see DE 10131156 A1 and WO 03/002269 A2).

In the case of a preferred component according to the invention for a painting facility, the plasma polymeric layer is a gradient layer, which can be produced by varying the polymerisation conditions over time. The plasma polymeric gradient layers for the preferred component and their generation are described in DE 10034737 A1, which is included in full in this application for the purpose of disclosure. The inclusion applies, in particular, to the method of producing the layer and the associated parameters.

As well as the stated elements oxygen, carbon and silicon the plasma polymeric coating preferably includes hydrogen (which cannot be demonstrated using ESCA) and/or fluorine, and the following applies:

1.8:1≤n (H and/or F):n (C)≤3.6:1 preferably 2.2:1≤n (H and/or F):n (C)≤3.3:1

The measurements of the proportion of hydrogen were carried out by microelement analysis, in which a salt crystal was coated first, so that the coating could be stripped off in a water bath. The stripped layer was dried at 100° C. until the weight was constant. The mass percentages for hydrogen and carbon were then determined.

In some cases, it is advantageous to generate an (essentially) fluorine-free or an (essentially) hydrogen-free layer.

Additionally, if the above-mentioned preferred ranges are chosen for the composition of the layer out of silicon, carbon and oxygen, and hydrogen and/or fluorine if appropriate, significant improvements regarding one or more of the properties stated below occur:

- thermal stability
- chemical stability
- mechanical stability
- hydrophobicity (quantifiable by giving the water edge angle)
- hardness According to the invention, for painting facilities the component surface to be coated can consist of various materials, e.g. plastic, metal, ceramic or glass. The substrate material which is chosen in the individual case is either given the plasma polymeric coating immediately, i.e. without pretreatment, or it is first cleaned superficially and/or activated and/or given a plasma polymeric adhesion promoter.

It is advantageous that in the case of the components according to the invention for painting facilities, even a base metal can be used as the substrate for the coating. This applies in particular if a steel or aluminium substrate is involved. A metal substrate can be galvanised, bronzed, etched, anodised, hot-galvanised, hot-tinned, heat treated, enameled, phosphated, processed mechanically or painted before the plasma polymeric layer is applied.

If the substrate to be coated is a hot-galvanised steel, preferredly any white rust which is present is removed first. This is preferredly done by a wet chemical method, again preferredly with acid or alkaline etchant. Specially preferredly, an acid which is used for white rust removal has a concentration of acid equivalent ($H^+$) of 1-3 mol/litre at 20° C. The preferred treatment time is 10-120 seconds. At a higher temperature, the proton concentration or treatment duration can preferably be reduced. At a higher proton concentration, the treatment duration can be shortened. Examples of acids to be used are hydrochloric acid or sulphuric acid.

Through the use of the plasma polymeric coating which is described in this text and the resulting material-saving cleaning conditions, it becomes possible to produce the components for painting equipment from materials other that what is currently usual and necessary in the prior art. In particular, light metals such as aluminium, and even plastic and rubber materials, can be used.

Additionally, the described plasma polymeric coatings can also protect surfaces (the expression "equipment free of substances which interfere with paint wetting" is used) which without this protection would be unusable in painting facilities, because, for instance, they cause paint faults because of abrasion. This applies in particular to components of the paint guns and their feed lines, e.g. rubber hoses and spouts.

Coatings other than the previously described silicon-organic coatings such as silicones or inorganic-organic hybrid polymers (which are marketed under the name "Ormocere", for instance) fulfil the requirements of the paint plant operators as little as do coatings containing PTFE. Although some of these coatings also ensure low adhesion of the paint to a coated substrate, they are unsuitable, since they usually cannot resist the high hydromechanical and cryomechanical stresses. This applies in general to high pressure water cleaners from a pressure of 400 bar, and to cleaning with dry ice from a pressure of over 5 bar. Also, with these coatings there is the danger that detached particles which reach the surfaces to be painted cause craters or blisters in the paint. On the other hand, the plasma polymeric layers described above have the advantage of being essentially stable even when high pressure water cleaners are used at up to 2500 bar of pressure.

Surprisingly, contamination of paints results in crater formation neither with particles which contain the coating according to the invention nor with the pure coating, as is the case with other "release layers" such as silicon-organic coatings produced by the sol-gel method, or PTFE coatings.

Thus the coating can be used even in paint plants where the paint overspray is reprocessed out of the water, although there is the danger that parts of the coating (separate or as coated particles) are painted on after recycling. In particular, with this coating, paint removal can also take place within the paint plant.

Components according to the invention where the raw value $R_a$ (determined according to DIN 4768) of a plasma polymeric coating which forms the surface has a value below 1 μm, preferredly a value of less than 0.3 μm, and more preferredly a value of less than 0.1 μm, are specially easy to clean. The surface of the coating is thus extremely smooth, which directly contradicts the discoveries which are combined under the term lotus effect.

Plasma polymeric coatings are contour-imitating, so that substrates with correspondingly smooth surfaces are specially suitable for producing articles which are easy to clean. To achieve a very smooth surface, metallic substrates can be subjected to mechanical, chemical and/or electrochemical smoothing, as is described, for instance, in DE 197 48 240 A1. Such smoothing of a metallic substrate can be followed by surface treatment by means of a reductively set plasma, particularly a hydrogen plasma, as is also described in DE 197 48 240 A1, and if metallic substrates are used, in particular this treatment will be provided if the plasma polymeric coating which is composed according to the invention is to be permanently joined to the metallic substrate.

The components for painting equipment can be recoated if sufficiently clean surfaces are offered. The recoating takes place shortly before the end of the time in use. If this is exceeded, the surface can be cleaned at very high pressure and made available to the recoating process.

Part of the invention is also a device for removing paint from components according to the invention for a painting facility, comprising at least one high pressure water nozzle, the high pressure water jet of which is directed onto the component which is movable in at least one direction relative to it. It is preferred that the component can be positioned on a receptacle which is movable in the at least one direction. Also preferred according to the invention is an embodiment in which the high pressure water nozzle rotates during operation. The high pressure water jet has a pressure of 300-700 bar, preferably 400-600 bar, specially preferredly 500 bar.

Preferredly, the device according to the invention is mounted on a mobile carrier, which specially preferredly is a lorry.

The device according to the invention for removing paint from components of a painting facility, with at least one high pressure water nozzle, the high pressure water jet of which is directed onto the components which are movable in at least one direction relative to it, makes possible very efficient, inexpensive and automatic paint removal from components, e.g. gratings, hangers and similar. It should be noted that the component can be in movable form relative to the high pressure water jet, and the high pressure water jet can be in movable form relative to the receptacle. A combination is also possible.

Preferredly, the at least one high pressure water nozzle rotates during operation, which improves the paint removal effect.

The high pressure water jet preferredly has a pressure of 300 to 700 bar, preferably 400 to 600 bar, in particular 500 bar. This pressure, which is only in the medium pressure range, makes possible a significantly longer useful life of the high pressure pumps which generate the pressure, since the wear on the high pressure pumps at this pressure is significantly less than at higher pressures which are known from the prior art.

The paint removal device also has an integrated drying facility. Because of this arrangement and in particular the movable receptacle for the components, one-sided or two-sided paint removal from the components, during forward and/or reverse motion, followed by optional drying is possible.

An advantageous embodiment provides a mobile carrier for the device, so it can be used in mobile form, and can thus be brought to various painting facilities and used there on site.

The paint removal device can also be part of a lorry superstructure. In this case, preferredly, an independent power supply, tanks for water supply and a compressor to generate the compressed air are provided, so that the system works completely independently.

Another part of the invention is the use of a plasma polymeric layer as defined above for coating components for painting facilities.

Another part of the invention is the use of a commercially available high pressure cleaner with lance for removing paint completely from a component according to the invention for a painting facility.

Another part of the invention is a method of removing paint from a component for a painting facility, comprising the following steps:

a) provision of a component according to the invention, which is contaminated with paint, for a painting facility, b) provision of a device according to the invention for removing paint from the components according to the invention for a painting facility, c) removing the contaminating paint from the component by means of the device.

In a preferred method according to the invention for paint removal, this takes place using dry ice in the form of pellets or snow. Use of dry ice which is as free of water as possible is preferred. The blasting of the component according to the invention for a painting facility preferredly takes place at a pressure <4 bar, specially preferredly <3.5 bar.

FIGURES

Other advantages and preferred features of the invention are the subject of the following description, the examples and the graphic representation of an embodiment.

Figure 2:
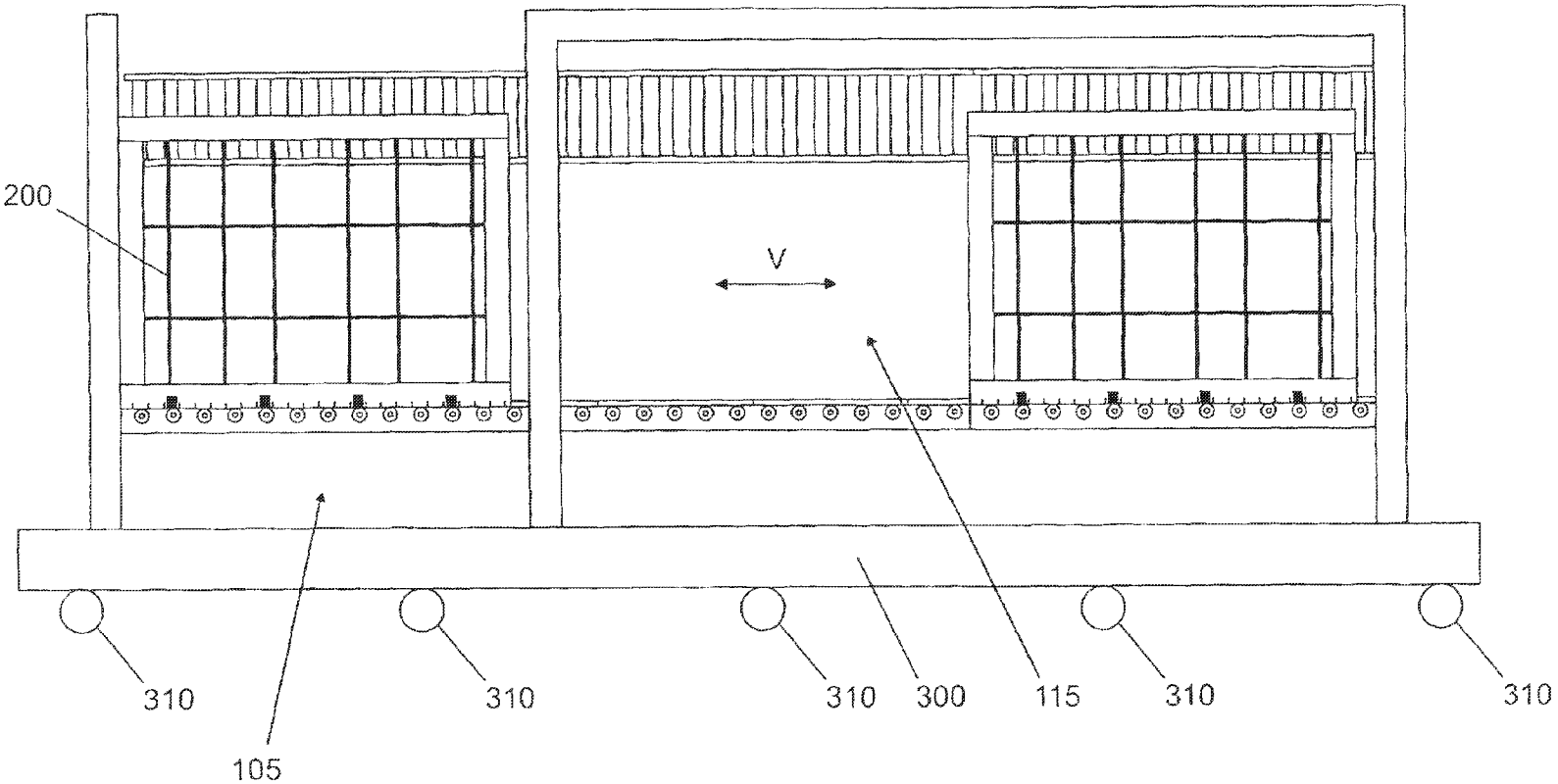

In the drawings:

FIG. 1 shows a side view of the paint removal device which makes use of the invention, and FIG. 2 shows a front view of the paint removal device.

EXAMPLE 1

Device for Paint Removal

A device for removing paint from components of a painting facility (not shown) which are contaminated with paint during operation of the painting facility, e.g. gratings, shown in FIGS. 1 and 2, includes an essentially horizontally arranged first bearing surface 100 and an essentially vertically arranged second bearing surface 120, on which components to be cleaned, e.g. gratings 200, lie. High pressure water jets are directed onto the gratings 200 along the directions marked with H. It should be noted that only one high pressure jet which is directed in one of the directions marked with H is sufficient for effective paint removal. The gratings 200 are moved along the movement directions marked with a double arrow V (FIG. 2). It is understood that instead of the gratings 200, the high pressure water jets can move relative to the gratings 200, while the gratings 200 stand still. Combinations are also conceivable. The device includes a first receptacle area 105, in which it is possible to push or pull the gratings 200 manually. Next to this is the actual paint removal area 115, in which the gratings 200 are automatically moved, e.g. by motors or similar, by tappets, e.g. friction wheels or similar, which as far as possible attack in the top area of the gratings 200.

The gratings 200 or other components of the painting facility have a coating with a plasma polymeric coating containing oxygen, carbon and silicon, as it is described in DE 101 31 156 A1, to which reference is made here and which is included in full here in this application for the purpose of disclosure. The coating can be joined to the grating via an intermediate layer.

The pressure of the high pressure water jet is between 300 and 700 bar, preferably between 400 and 600 bar, in particular 500 bar. It is consequently in the medium pressure range. In the case of high pressure water pumps which are known per se, such a pressure causes significantly less wear than pressures which are used in paint removal facilities which are known from the prior art, and which are over 1000-1200 bar. Additionally, the water throughput is significantly less, so that the device can be used cost-efficiently. The high pressure water nozzles (not shown) preferably rotate during operation, so that specially effective paint removal is achieved.

Preferredly, the high pressure water pump is integrated in a circuit system, which includes a water tank and the required components for water processing (not shown).

The device can also include a drying facility (not shown) next to the paint removal area, into which the gratings 200 are moved from the paint removal area 115 described above, and in the case of multiple paint removal operations, moved back from it to the paint removal area 115.

The whole device is arranged on a mobile carrier 300, which for instance has wheels 310 for movement, or is itself in the form of a container. It has appropriate connections for supply systems which exist on site for power, compressed air and fresh water, and disposal systems for waste water and exhaust air. In this way, the whole device can be used in mobile form, and can be brought to painting facilities where it can be used on site.

The paint removal device described above can also, for instance, be integrated in a superstructure of a lorry (not shown), to be brought to painting facilities in this way. The carrier 300 then forms the lorry superstructure. In this case, the device preferredly has its own power supply by means of an appropriate power-generating unit, also tanks for water supply and a compressor to generate the compressed air, so that the system works completely independently.

Just in passing, it should be noted that the painting facility components according to the invention described above, such as gratings, hangers or cover plates, purely in principle can advantageously and simply be cleaned manually, even with a commercially available high pressure cleaner with lance (with up to 500 or up to 250 bar water pressure) which is known per se, with and without support from brushes and hot water or steam, which in the case of components which are known per se, and do not have the coating according to the invention, is practically impossible or significantly more time-consuming, because in the case of paint removal with commercially available high pressure cleaners, some paint remains stuck to the components.

EXAMPLE 2

First Test of Paint Compatibility

A hot-galvanised plate was fine-cleaned by means of a low pressure oxygen plasma (at a frequency of 13.56 MHz). Then, at the same frequency, the plasma polymeric coating was applied, the plasma being formed out of oxygen $O_2$ and hexamethyldisiloxane (HMDSO). The ratio of oxygen to HMDSO was varied so that the gas flow of HMDSO was finally in the ratio of 27.5:100 to the gas flow of $O_2$. The precise finally applying method parameters for the deposition of the plasma polymeric coating are given in Table 1.

To simulate a possible removal of the approx. 180 nm thick coating experimentally, the surface was abraded off using a fine abrasive paper. As reference, the same was done to an untreated hot-galvanised steel plate and a non-stick silicon-organic coating, which was applied to a steel substrate by the sol-gel method.

The abraded-off dust was then stirred into a water-based base coat paint and painted by the spray method onto a steel substrate with a coil coating.

Whereas in the case of a coating according to the invention and the untreated substrate, apart from the zinc particles no painting faults could be detected, the paint with the powder of the silicon-organic reference substrate showed craters and blisters on some metal particles as well as on the surface.

TABLE 1

| | |
|---|---|
| Gas flow $O_2$ (sccm): | 100 |
| Gas flow HMDSO (sccm): | 27.5 |
| Power (W): | 2500 |
| Time (sec): | 300 |
| Pressure (mbar): | 0.03 |

EXAMPLE 3

Second Test of Paint Compatibility

Standard household crystal sugar was given a plasma polymeric coating according to the invention three times. The surface of the crystal sugar was activated by means of an oxygen plasma. The plasma polymeric coating was then applied, the plasma being formed out of oxygen $O_2$ and hexamethyldisiloxane (HMDSO). The ratio of oxygen to HMDSO was varied so that the gas flow of HMDSO was finally in the ratio of 27.5:100 to the gas flow of $O_2$. The precise finally applying method parameters for the deposition of the plasma polymeric coating are given in Table 1.

To determine the layer thickness, silicon wafers were coated in parallel in the same process. The result of the layer thickness measurement was 557 nm.

To investigate the paint compatibility, in each case 1 g and 3 g of the coated sugar were dissolved in 10 millilitres of water, and 100 millilitres of a water-based base coat paint were added. The paint was sprayed onto a steel substrate with the plasma polymeric thin layer, which was pulverised by stirring. The painting showed no painting faults such as blisters or craters; externally, it could not be distinguished from the reference samples, to which uncoated sugar was added in the same way as to the paint.

EXAMPLE 4

Testing Paint Adhesion

Hot-galvanised steel sheets were given a plasma polymeric coating as in Example 3. The sheet was then painted with the solvent top coat CA 8100 from the PPG Industries company. A cross-cut adhesion test according to DIN EN ISO 2409 which was then carried out gave a value of GT5, which means that after cutting in the grid and subsequent brushing away within the cut-in grid, on a surface which is essentially greater than 65% of the surface between the cut edges, the paint flaked off, the paint in this case having been carried away completely from the substrate at scratching. On an uncoated reference substrate, GT3 was obtained, meaning that after scratching in a grid and then brushing away, on 15 to 35% of the surface between the cut edges the paint flaked off.

EXAMPLE 5

Pretreatment of Hot-Galvanised Surfaces

Hot-galvanised gratings with a thin white rust coating were each etched under one of the following conditions:

- 40 seconds in a mixture of 1 litre 35% hydrochloric acid and 50 litres water (0.19 mol $H^+$/litre)
- 40 seconds in a mixture of 3 litres 35% hydrochloric acid and 50 litres water (0.54 mol $H^+$/litre)
- 40 seconds in a mixture of 5 litres 35% hydrochloric acid and 50 litres water (0.87 mol $H^+$/litre)
- 40 seconds in a mixture of 7.5 litres 35% hydrochloric acid and 50 litres water (1.25 mol $H^+$/litre)
- 60 seconds in a mixture of 7.5 litres 35% hydrochloric acid and 50 litres water (1.25 mol $H^+$/litre)
- 20 seconds in a mixture of 5.9 litres 35% hydrochloric acid and 31.1 litres water (1.53 mol $H^+$/litre)
- 20 seconds in a mixture of 5.9 litres 35% hydrochloric acid and 26.1 litres water (1.77 mol $H^+$/litre)
- 20 seconds in a mixture of 5.9 litres 25% sulphuric acid and 26.1 litres water (1.77 mol $H^+$/litre)
- 20 seconds in a mixture of 3 litres 25% sulphuric acid and 4.7 litres water (2.00 mol $H^+$/litre).
- 20 seconds in a mixture of 1 litre 96% sulphuric acid and 8.8 litres water (2.00 mol $H^+$/litre).
- 20 seconds in a mixture of 3 litres 25% sulphuric acid and 6.0 litres water (1.70 mol $H^+$/litre).
- 20 seconds in a mixture of 1 litre 96% sulphuric acid and 10.5 litres water (1.70 mol $H^+$/litre).
- 20 seconds in a mixture of 1.75 litres 96% sulphuric acid and 18.4 litres water (1.70 mol $H^+$/litre).
- 20 seconds in a mixture of 2.1 litres 96% sulphuric acid and 18.4 litres water (2.01 mol $H^+$/litre).
- 20 seconds in a mixture of 2.7 litres 96% sulphuric acid and 18.4 litres water (2.51 mol $H^+$/litre).
- 20 seconds in a mixture of 3.3 litres 96% sulphuric acid and 18.4 litres water (2.98 mol $H^+$/litre).

The gratings were then rinsed in de-ionised water and dried with a hot air fan.

Treatment for 40 seconds with hydrochloric acid at a concentration of 0.19 mol $H^+$/litre proved to be inadequate for removing the white rust sufficiently.

It was shown that after 40 seconds of treatment with hydrochloric acid at a concentration of 0.54 and 0.87 mol $H^+$/litre, and after 20 seconds of treatment with hydrochloric acid at a concentration of 1.53 mol $H^+$/litre, and after treatment with sulphuric acid at a concentration of 1.70 mol $H^+$/litre, a thin, loose coating of white rust was still present, whereas with a hydrochloric acid concentration of 1.77 mol $H^+$/litre and with a sulphuric acid concentration of 2.98 mol $H^+$/litre, loose black corrosion products remained on the galvanised surface. With the intermediate settings, traces of white and black powder remained on the surface. To remove this powder, some of the gratings were sprayed down with a high pressure water cleaner before being dried with the hot air fan.

After this treatment, the gratings were coated as in Example 3. Subsequent painting with Glasurit Universalgrund (paint on copolymer resin basis) from the Akzo Nobel Deco GmbH company, after curing, was tested for adhesion with a strip of "Budget" adhesive tape from the TESA company.

It was shown that all stated pretreatment methods except the treatment for 40 seconds with hydrochloric acid at a concentration of 0.19 mol $H^+$/litre are suitable for removing a white rust coating for the coating according to the invention.

Specially preferred were the treatment for 20 seconds with hydrochloric acid at a concentration of 1.77 mol $H^+$/litre and the treatment for 20 seconds with sulphuric acid at a concentration of 2.01 mol $H^+$/litre. Here the paint could be pulled off without previous scratching, by pulling off the Tesafilm quickly, and the paint was even pulled off a few cm wider than the extent of the Tesafilm.

EXAMPLE 6

Durability of the Coating

A galvanised grating was plasma-coated with the process parameters given in Example 3. The grating was then painted ten times with a water-based base coat paint, and cleaned with a high pressure water cleaner at 2500 bar. Even after that, the coating could be detected both through the low surface energy and through the low adhesion of the Glasurit Universalgrund.

The same method was also used for paint removal with dry ice. Here too, durability of the plasma polymeric coating after paint removal with dry ice granulate and a broad slit nozzle at up to 3.5 bar could be established.

The invention claimed is:

1. Method for removing adhering paint completely from a component of a painting facility, said method comprising:

providing said component contaminated with adhering paint, wherein said component comprises at least one of a grating, a hanger, and a cover of a painting facility, characterized in that the component is coated with a plasma polymeric coating containing oxygen, carbon and silicon, wherein the plasma polymeric coating is capable of avoiding paint faults and wherein the paint adheres to said plasma polymeric coating, and using a high-pressure cleaner at a pressure between 300 and 700 bar with lance to remove the adhering paint completely from the component while the plasma polymeric coating remains stable at a pressure of at least 400 bar and up to 2500 bar.

2. Method of removing adhering paint incidentally applied to components in a painting facility, comprising:

accessing a component, which is contaminated with adhering paint, for a painting facility during operation of the painting facility, the component comprising at least one of a grating, a hanger, and a cover, characterized in that said component is coated with a plasma polymeric coating containing oxygen, carbon and silicon, wherein the plasma polymeric coating is capable of avoiding paint faults and wherein the paint adheres to the plasma polymeric coating, providing at least one high-pressure water nozzle, a high-pressure water jet of each of which is directed onto the component and that is movable in at least one direction relative to said component; and directing high-pressure water at a pressure of 300 to 700 bar onto the component to remove the adhering paint while the plasma polymeric coating remains stable at a pressure of at least 400 bar and up to 2500 bar.

3. Method for removing adhering paint completely from a coated component for a painting facility, comprising:

accessing a coated component contaminated with adhering paint, the coated component comprising at least one of a grating, a hanger, and a cover, wherein:

the component is coated with a plasma polymeric coating containing oxygen, carbon and silicon, wherein the plasma polymeric coating is capable of avoiding paint faults and wherein the paint adheres to said plasma polymeric coating;

the plasma polymeric coating is a gradient layer, which can be produced by varying the plasma polymerisation conditions over time; and the plasma polymeric coating includes hydrogen and/or fluorine, and the following ratio applies: $1.8:1 < n\,(H \text{ and/or } F):n\,(C) < 3.6:1$; and removing the adhering paint from the component while the plasma polymeric coating remains stable at a pressure of at least 400 bar and up to 2500 bar with a high pressure water jet at a pressure between 300 and 700 bar.

4. Method according to claim 2, wherein the ratio of at least one of hydrogen and fluorine to carbon in the plasma polymeric coating is greater than 2.2:1 and less than 3.3:1.

5. Method of removing adhering paint from a component for a painting facility, comprising:

providing a coated component that is contaminated with adhering paint, the coated component selected from the group comprising a grating, a hanger, or a cover, and the coating being a plasma polymeric coating containing oxygen, carbon, and silicon, wherein the plasma polymeric coating is capable of avoiding paint faults and wherein the paint adheres to said plasma polymeric coating; and providing a device having at least one high pressure water nozzle, a high pressure water jet of each of which is directed onto the component and that is movable in at least one direction relative to said component and including at least one of:

the component can be positioned on a receptacle which is movable in the at least one direction;

the high pressure water nozzle rotates during operation;

the high pressure water jet has a pressure of 300 to 700 bar;

the device can be transported on a mobile carrier; and the device can be mounted onto a lorry superstructure;

removing the adhering paint using the device while the plasma polymeric coating remains stable at a pressure of at least 400 bar and up to 2500 bar.

6. Method of removing adhering paint from a component contaminated with adhering paint in a painting facility, the method comprising:

accessing the component contaminated with adhering paint, the component having a plasma polymeric coating containing oxygen, carbon, and silicon, wherein the plasma polymeric coating is capable of avoiding paint faults and wherein the paint adheres to the plasma polymeric coating;

directing at least one high-pressure water jet at a pressure between 300 and 700 bar with a lance onto the accessed component; and moving the at least one high-pressure water jet in at least one direction relative to said component to remove paint while the plasma polymeric coating remains stable at a pressure of at least 400 bar and up to 2500 bar.

7. The method as recited in claim 6, wherein the accessing step includes accessing the component with a coating having polymerization under various conditions with time to produce a gradient layer.

8. The method as recited in claim 6, wherein the accessing step includes accessing the component with a coating layer that is at least one of fluorine-free, substantially fluorine-free, hydrogen-free, and substantially hydrogen-free.

* * * * *

UNITED STATES PATENT AND TRADEMARK OFFICE

CERTIFICATE OF CORRECTION

PATENT NO. : 8,574,375 B2
APPLICATION NO. : 11/887851
DATED : November 5, 2013
INVENTOR(S) : Matthias Ott et al.

It is certified that error appears in the above-identified patent and that said Letters Patent is hereby corrected as shown below:

In the Claims

Column 10, claim 4, line 31, "according to claim 2" should read --according to claim 3--.

Signed and Sealed this
Second Day of September, 2014

Michelle K. Lee

Michelle K. Lee
*Deputy Director of the United States Patent and Trademark Office*